US006712182B1

(12) United States Patent
Baker

(10) Patent No.: US 6,712,182 B1
(45) Date of Patent: Mar. 30, 2004

(54) PORTABLE COLLAPSIBLE SCAFFOLDING FOR ANGLED SURFACES

(76) Inventor: George M. Baker, 2103 Union Valley Rd., Perryville, AR (US) 72126

( * ) Notice: Subject to any disclaimer, the term of this patent is extended or adjusted under 35 U.S.C. 154(b) by 0 days.

(21) Appl. No.: 10/041,889

(22) Filed: Jan. 10, 2002

(51) Int. Cl.[7] ..... E04G 1/00
(52) U.S. Cl. ..... 182/225; 182/153; 182/129
(58) Field of Search ..... 182/225, 153, 182/181.1, 129; 248/77, 78

(56) References Cited

U.S. PATENT DOCUMENTS 1,725,168 A * 8/1929 Willis ..... 182/225
2,549,212 A * 4/1951 Lane ..... 182/182.1
4,029,173 A 6/1977 Wakabayashi ..... 182/150
4,153,229 A 5/1979 Bequette ..... 248/240.3
4,241,808 A * 12/1980 Middleton et al. ..... 182/155
4,576,251 A 3/1986 Matsuura et al. ..... 182/152
4,673,060 A 6/1987 Gregory ..... 182/82

* cited by examiner

*Primary Examiner*—Alvin Chin-Shue
(74) *Attorney, Agent, or Firm*—Sturm & Fix LLP

(57) ABSTRACT

A collapsible scaffolding apparatus (10) for inclined or angled surfaces such as roof lines (100) wherein the apparatus (10) includes a pair of adjustable length support leg members (30) each having an upper leg segment (31) and a lower leg segment (32) provided with a pivoted foot element (39) wherein the upper leg segments (31) are connected both to one another and to one end (21) of an elongated horizontal support arm member (20) wherein the other end 22 of the horizontal support arm member (20) is optionally provided with a vertical (70) or horizontal (80) connector element to operatively engage the scaffolding apparatus (10) either to a vertical wall surface (101) or to the other end (22') of a mirror image scaffolding apparatus (10').

5 Claims, 3 Drawing Sheets

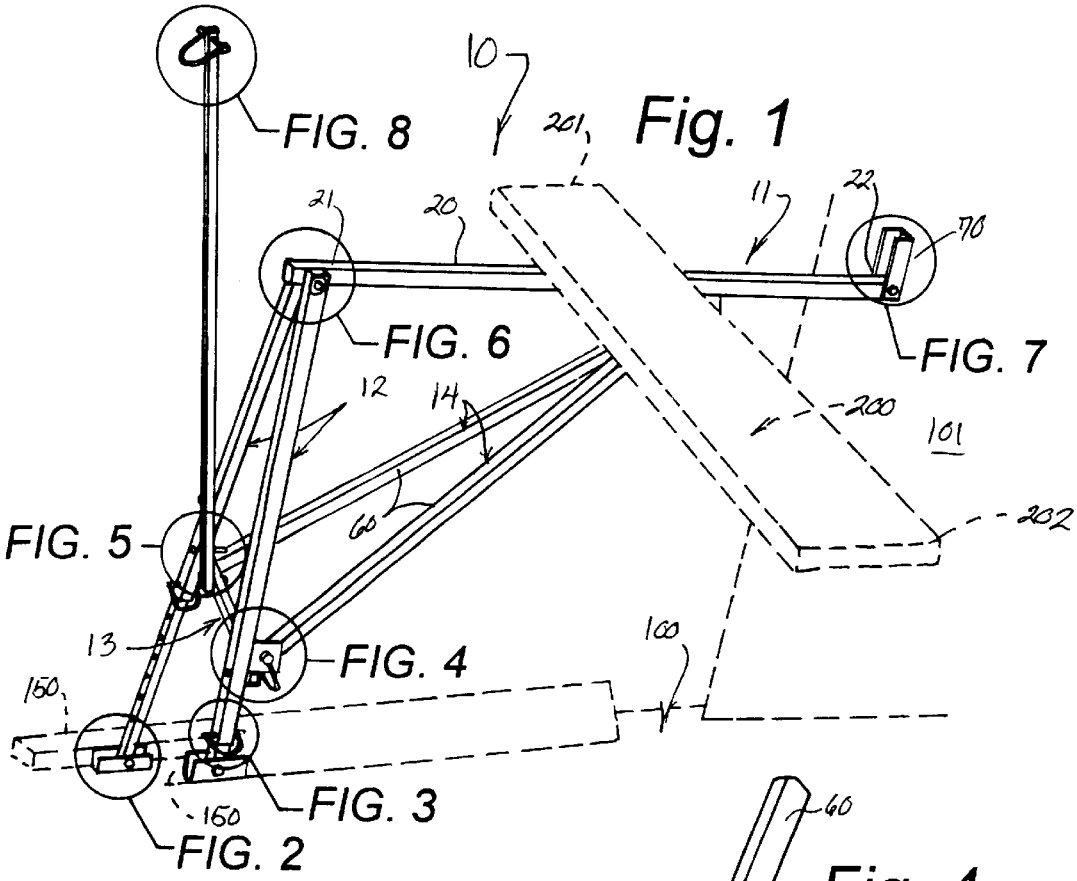
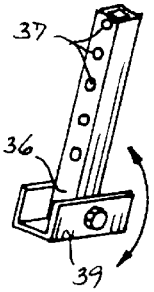
Fig. 2
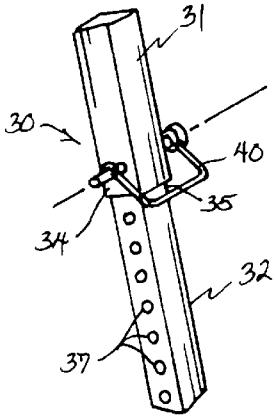
Fig. 3
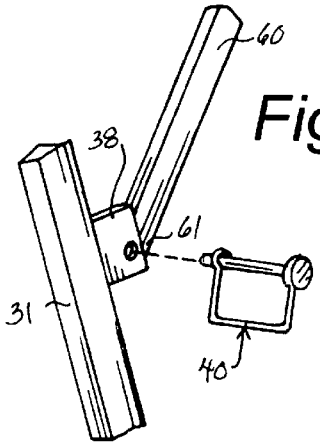
Fig. 4
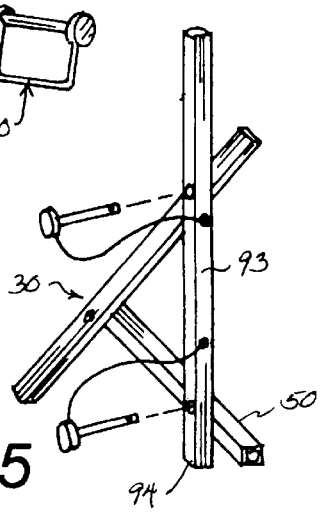
Fig. 5

PORTABLE COLLAPSIBLE SCAFFOLDING FOR ANGLED SURFACES

CROSS REFERENCE TO RELATED APPLICATIONS

This invention was the subject matter of Document disclosure Program registration number 493431 filed on May 14, 2001.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of collapsible scaffolding arrangements in general and in particular to a collapsible scaffolding apparatus specifically designed for angled or uneven surfaces.

2. Description of Related Art

As can be seen by reference to the following U.S. Pat. Nos. 4,029,173; 4,673,060; 4,576,251; and, 4,153,229, the prior art is replete with myriad and diverse collapsible scaffolding arrangements.

While all of the aforementioned prior art constructions are more than adequate for the basic purpose and function for which they have been specifically designed, they are uniformly deficient with respect to their failure to provide a simple, efficient, and practical adjustable scaffolding arrangement that is particularly well suited for angled surfaces such as roof lines.

As anyone in the home construction field is all too well aware, the most dangerous area to work on a new home is on the roof due to the complete absence of horizontal support surfaces for not only workmen, but for their tools and materials as well. The angled roof lines not only make stable footing for the workmen a problem, but any unsecured materials or tools that are dropped are prone to sliding completely off the angled roof surface.

As a consequence of the foregoing situation, there has existed a longstanding need in the construction trades for a new and improved portable and collapsible scaffolding apparatus that can quickly and easily be erected on an uneven surface to provide a stable horizontal support surface for the workmen, their tools and work materials; and the provision of such a construction is a stated objective of the present invention.

BRIEF SUMMARY OF THE INVENTION

Briefly stated, the portable collapsible scaffolding apparatus that forms the basis of the present invention comprises in general a pair of support leg units, a support arm unit, a pair of angled brace units and at least one horizontal brace unit that cooperate with one another to form the basic scaffolding apparatus that may be employed either alone or in combination with an identical version of itself depending on the roof structures involved.

As will be explained in greater detail further on in the specification, each of the support leg units comprises adjustable length support leg members having upper leg segments and lower leg segments telescopically associated with one another wherein the upper leg segments are connected to one another and to one end of the support arm unit which includes a horizontal support arm member.

In addition, the horizontal support arm member is also operatively connected to each of the upper segments of the support leg members by the pair of angled brace units, and the other end of the horizontal support arm member may optionally be provided with either a vertical connector element that is releasably engagable with a vertical wall surface or a horizontal connector element that is releasably engagable with the other end of the horizontal support arm member on a mirror image scaffolding apparatus.

Furthermore, the upper leg segments of the support leg members are connected by at least one horizontal brace unit which at least partially supports a D-ring support post that is also supported by one of the support leg members and is provided with an enlarged support arm member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of the basic components of the portable collapsible scaffolding apparatus that forms the basis of the present invention;

FIG. 2 is an enlarged detail view of the lower portion of one of the support leg units;

FIG. 3 is an enlarged detail view of the adjustable length feature on the support leg units;

FIG. 4 is an enlarged detail view of the operative connection between one of the support leg units and an angled brace unit;

FIG. 5 is an enlarged detail view of the operative connection of an optional D-ring support post to the basic scaffolding apparatus;

DETAILED DESCRIPTION OF THE INVENTION

Figure 6:
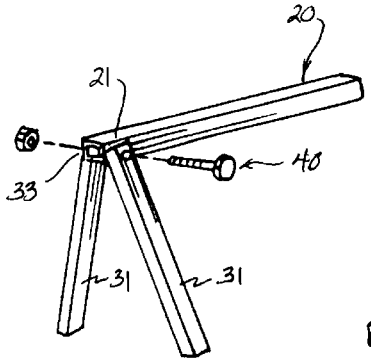
FIG. 6 is an enlarged detail view of the operative connection between the pair of support leg units and the support arm unit.

As can be seen by reference to the drawings, and in particularly to FIG. 1, the collapsible scaffolding apparatus that forms the basis of the present invention is designated generally by the reference number 10. The apparatus 10 comprises in general a horizontal support arm unit 11, a pair of support leg units 12, at least one horizontal brace unit 13 and a pair of angled brace units 14. These units will now be described in seriatim fashion.

As shown in FIGS. 1, 6, 7, and 10, the horizontal support arm unit 11 comprises an elongated support arm member 20 having apertured inboard 21 and outboard 22 ends and a downwardly depending bracket element 23 disposed at a spaced distance from the outboard end 22 wherein the support arm member 20 is fabricated from hollow tubular stock having a generally square cross-sectional configuration.

As can be seen by reference to FIGS. 1 through 6 and 9, each one of the pair of support leg units 12 comprises an adjustable length support leg member 30 having an upper leg section 31 that telescopically receives a lower leg section 32; wherein, the upper 33 and lower 34 ends of the upper leg segments 31 as well as the upper 35 and lower 36 ends of the lower leg segment 32 is provided with a plurality of vertically spaced apertures 37 for reasons that will be explained presently.

In addition, the upper leg section 31 is provided with a mounting bracket 38 disposed proximate to, but spaced from, its lower end 34 and the lower leg section 32 is provided with a generally U-shaped foot element 39 that is pivotally secured to the lower end 36 of the lower leg segment 32.

As can best be appreciated by reference to FIGS. 1 through 3, and 6, the upper ends 33 of the upper leg segments 31 are pivotally secured to one another and the inboard end 21 of the horizontal support arm member 20 and the upper leg segments 31 are secured in a vertically adjustable fashion relative to the lower leg segments 32 by conventional securing elements 40 such as wire lock pins, nuts, threaded bolts, or the like.

Figure 9:
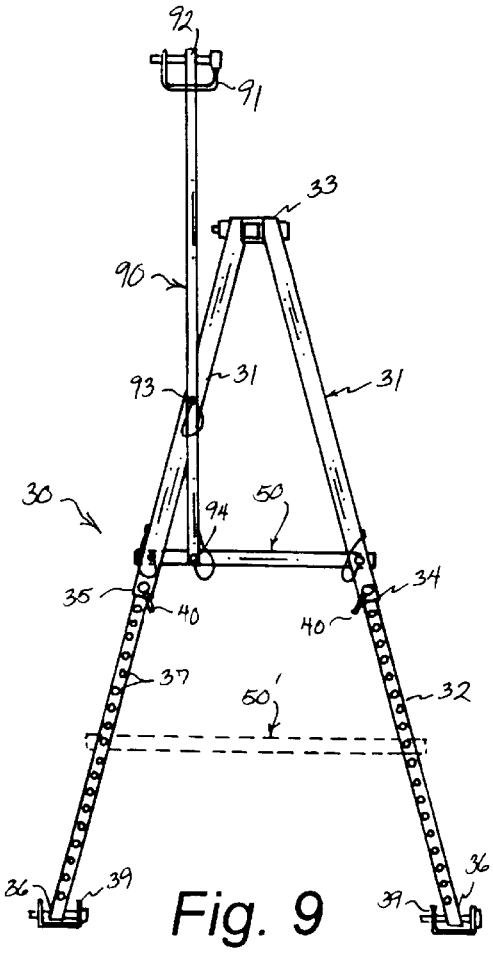
FIG. 9 is an end view of the arrangement depicted in FIG. 1.
Figure 10:
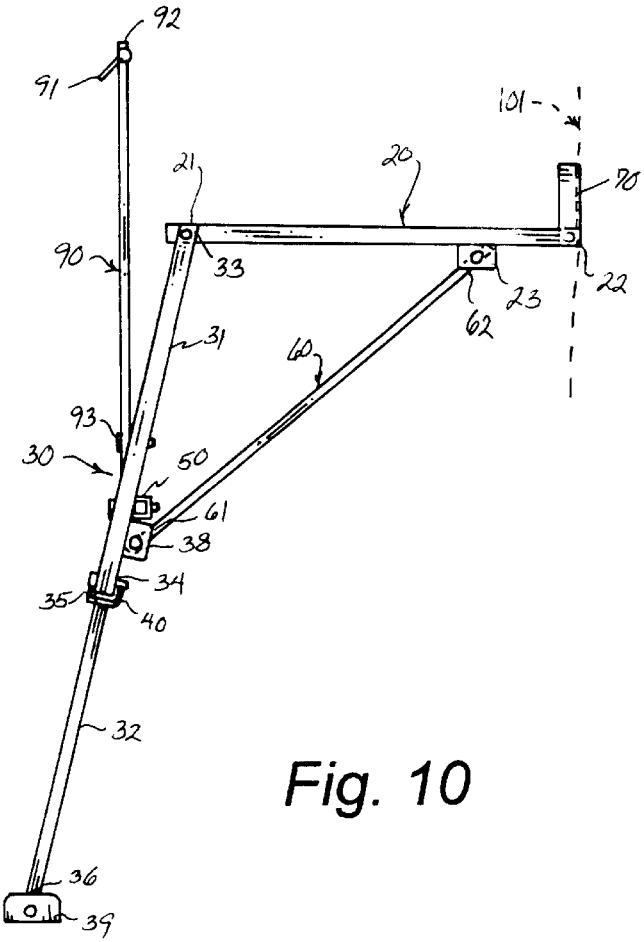
FIG. 10 is a side elevation view of the arrangement depicted in FIG. 1; and, FIG. 11 is an enlarged detail view of the connector member used to join a pair of the scaffolding apparatus together.

Turning now to FIGS. 5, 9, and 10, it can be seen that the horizontal brace unit 13 comprises at least one horizontal brace member 50 that operatively connects at the lower ends 34 of the upper leg segments 31 to one another; whereas, an optional auxiliary horizontal brace member 50' may be employed to operatively connect the lower leg segments 32 together to provide additional structural rigidity to the scaffold apparatus 10 in a well recognized manner.

Furthermore, as shown in FIGS. 1, 4, 9, and 10, each of the pair of angled brace units 14 comprises an elongated brace member 60 having apertured ends 61 62 that are secured to the bracket elements 38 and 23 on the support leg members 30 and the support arm member 20 respectively to rigidify the operative connection between those members.

Figure 7:
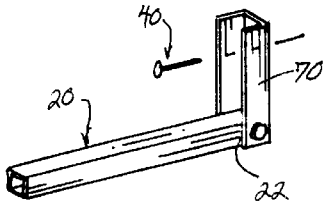
FIG. 7 is an enlarged detail view of the addition of a vertical surface engagement bracket with the outboard end of the horizontal support arm unit.
Figure 8:
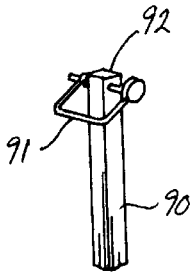
FIG. 8 is an enlarged detail view of the upper end of the optional D-ring support post.

Turning now to FIGS. 1, 7, and 10, it can be seen that in certain instances wherein a vertical wall surface 101 projects upwardly from a roof line 100, only a single scaffold apparatus 10 is required to create a stable horizontal support surface 200 by use of a vertical connector element 70 on the outboard end 22 of the horizontal support arm member 20 wherein the vertical connector element 70 on the outboard end 22 of the horizontal support arm member 20 wherein the vertical connector element 70 is pivotally secured on the outboard end 22 of the support arm member 20 and temporarily affixed to the vertical wall surface by a conventional securing element 40 in a well recognized manner.

Figure 11:
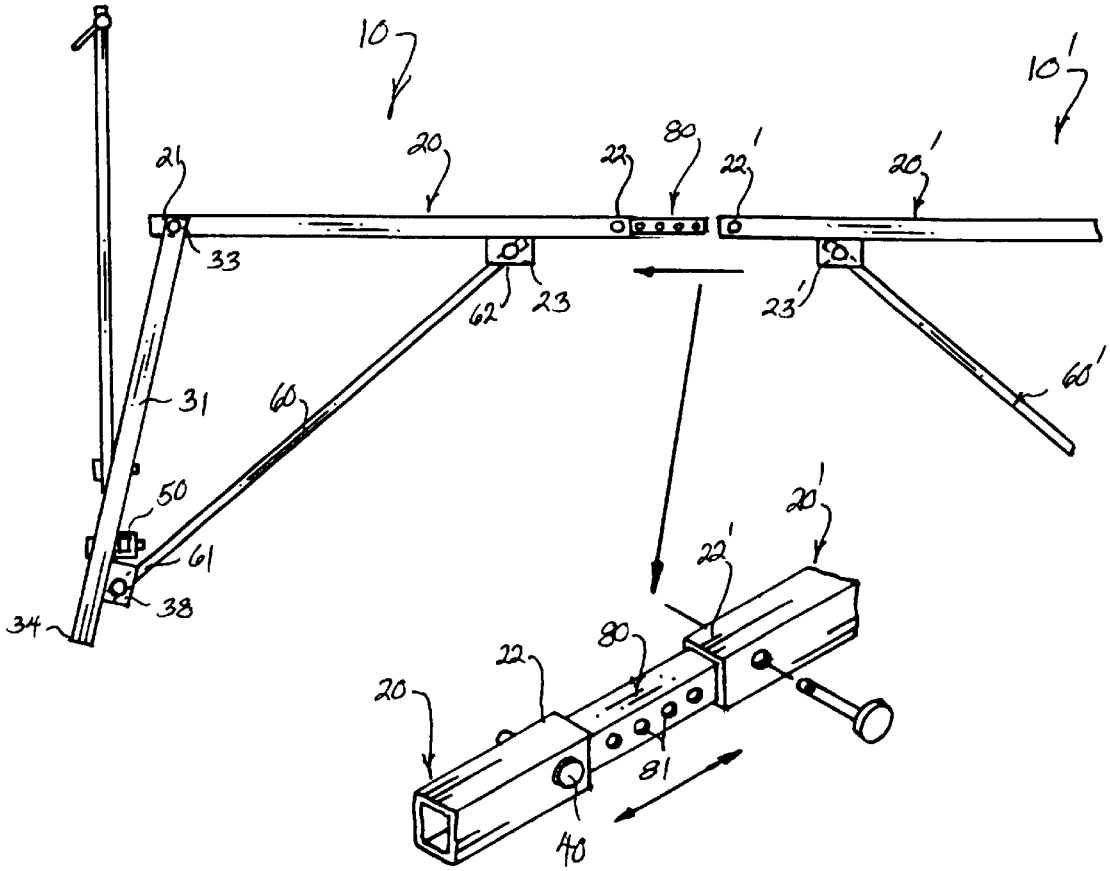

In those instances wherein a vertical wall surface 101 is not available, a second identical scaffold apparatus 10' may be operatively connected to the primary scaffold apparatus 10 by use of a horizontal connector element 80 having a plurality of horizontally spaced apertures 81 as depicted in FIG. 11. The horizontal connector element 80 is dimensioned to be slidably received within the opposed ends 22 22' of the respective horizontal support arms 20 20' and retained therein by conventional securing elements 40 which extend through the apertured ends 22 22' of the respective scaffold apparatus 10 10'.

As was mentioned previously and depicted in FIGS. 1, 5, and 8 through 10, this invention also contemplates the provision of an optional D-ring support post 90 having an enlarged D-ring element 91 pivotally suspended from the upper end 92 of the support post 90 wherein the intermediate portion 93 and lower end 94 of the support post 90 are operatively connected respectively to one of the upper leg segments 31 and the horizontal brace member 50 such that air hoses and/or electrical wires can be threaded through the D-ring element 91 to suspend those hoses and/or wires above the roof line and operatively connect them to the scaffold apparatus 10 so that they do not slide off of the angled roof line.

In operation, a pair of leg blocks 150 would be temporarily secured to the roof line 100 to act as braces that the feet 39 of the support leg members 30 could rest against once the length of the support leg members 30 have been adjusted to place the top of the support arm member 20 in the horizontal plane when the vertical connector element 80 of FIG. 11 is operatively deployed thereon.

At this juncture, a horizontal support surface 200 such as planking or the like would have one end 201 supported by the horizontal support arm member 20 and the other end 202 would rest on the roof line surface at the same height as the horizontal support arm member 20 of the scaffold apparatus 10 to provide a stable work support surface for the workmen.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A collapsible scaffolding apparatus for use on angled surfaces such as roof lines or the like wherein, the scaffolding apparatus comprises a horizontal support arm unit including an elongated horizontal support arm member having a first end, a second end, and an intermediate portion a pair of support leg units wherein each support leg unit comprises an elongated adjustable length support leg member having an upper leg segment and a lower leg segment provided with a pivoted foot element; and, wherein each of the upper leg segments are operatively connected to one another and the first end of the elongated horizontal support arm member;

at least one angled brace unit including an angled brace member operatively connected to the upper leg segment of one of the support leg members and the horizontal support arm member; and, a support post operatively connected to said at least one horizontal brace unit and the upper leg segment of one of said support leg members wherein the support post has an upper end provided with an enlarged D-ring element.

2. The scaffolding apparatus as in claim 1 further comprising a pair of angled brace units wherein each of the angled brace units comprises an elongated brace member extending from the upper leg segment of each support leg member to the horizontal support arm member.

3. The scaffolding apparatus as in claim 2 further comprising at least one horizontal brace unit including a horizontal brace member operatively connected to the upper leg segments of each of the adjustable length support leg members.

4. The scaffolding apparatus as in claim 2, wherein the second end of the horizontal support arm member is further provided with a vertical connector element releasably associated with said second end of the horizontal support arm member and adapted to be releasably engaged with a vertical wall surface.

5. The scaffolding as in claim 2, wherein, the horizontal support arm member is further provided with a second end having a horizontal connector element that is adapted to be releasably engaged with the second ends of the horizontal support arm members of two mirror image scaffolding apparatus.

* * * * *